US007000698B2

(12) United States Patent
Mayeu et al.

(10) Patent No.: US 7,000,698 B2
(45) Date of Patent: Feb. 21, 2006

(54) METHODS AND SYSTEMS FOR OPTICAL ENDPOINT DETECTION OF A SLIDING SLEEVE VALVE

(75) Inventors: Christopher W. Mayeu, Houston, TX (US); Richard M. Wilde, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 8 days.

(21) Appl. No.: 10/408,585

(22) Filed: Apr. 7, 2003

(65) Prior Publication Data

US 2004/0194958 A1 Oct. 7, 2004

(51) Int. Cl.
*E21B 47/09* (2006.01)

(52) U.S. Cl. ..... 166/255.1; 166/66; 166/66.7

(58) Field of Classification Search ..... 166/255.1, 166/66, 66.6, 66.7; 137/554
See application file for complete search history.

(56) References Cited

U.S. PATENT DOCUMENTS

| | | | | |
|---|---|---|---|---|
| 4,356,397 | A | 10/1982 | Lenderking et al. | |
| 4,560,005 | A | 12/1985 | Helderle et al. | |
| 4,848,457 | A | 7/1989 | Lilley | |
| 5,211,241 | A | 5/1993 | Mashaw, Jr. et al. | |
| 5,263,683 | A | 11/1993 | Wong | |
| 6,044,908 | A | 4/2000 | Wyatt | |
| 2001/0015276 | A1 | 8/2001 | Pringle et al. | |
| 2002/0007948 | A1 * | 1/2002 | Bayne et al. | 166/278 |
| 2003/0127232 | A1 * | 7/2003 | Bussear et al. | 166/373 |
| 2004/0140092 | A1 * | 7/2004 | Robison | 166/255.1 |

FOREIGN PATENT DOCUMENTS

| | | |
|---|---|---|
| GB | 2 246 617 | 5/1992 |

OTHER PUBLICATIONS

U.S. Appl. No. 10/339,263, filed Jan. 9, 2003, Hay et al.
U.S. Appl. No. 10/373,146, filed Feb. 24, 2003, Mayeu et al.
U.K. Search Report, Application No. GB 0407903.4, dated Aug. 12, 2004.

* cited by examiner

*Primary Examiner*—David Bagnell
*Assistant Examiner*—Giovanna M. Collins
(74) *Attorney, Agent, or Firm*—Patterson & Sheridan, L.L.P.

(57) ABSTRACT

Methods and systems for optical endpoint detection of a sliding sleeve valve are disclosed. The system comprises fiber optic cable based sensors (e.g., fiber Bragg gratings or fiber optic coils) positioned in a recess within the valve's housing and affixed proximate to the ends of the cavity in which the sleeve travels. When the sleeve reaches the ends of the cavity, it imparts a stress onto an area of the housing, which preferably constitutes a protrusion within the cavity, which in turn stresses the sensor and changes its reflection profile. This change in reflection profile indicates that the sleeve has traveled to an end point inside the valve, and accordingly that the valve is fully open or fully closed.

33 Claims, 5 Drawing Sheets

METHODS AND SYSTEMS FOR OPTICAL ENDPOINT DETECTION OF A SLIDING SLEEVE VALVE

FIELD OF THE INVENTION

This application pertains to a system and method for detection of the position of a sliding sleeve valve useful in the production of hydrocarbons from a well.

BACKGROUND OF THE INVENTION

In hopes of producing oil and gas more efficiently, the petroleum industry continuously strives to improve its recovery systems. As such, those in the industry often drill horizontal, deviated, or multilateral wells, in which several wells are drilled from a main borehole. In such wells, the wellbore may pass through numerous hydrocarbon-bearing zones or may pass for an extended distance through one hydrocarbon-bearing zone. Perforating or "fracturing" the well in a number of different locations within these zones often improves production by increasing the flow of hydrocarbons into the well.

In wells with multiple perforations, however, managing the reservoir becomes difficult. For example, in a well having multiple hydrocarbon-bearing zones of differing pressures, zones of high pressure may force hydrocarbons into zones of lower pressure rather than to the surface. Thus, independent control of hydrocarbon flow from each perforation, or zone of perforations, is important to efficient production.

To independently control hydrocarbon flow from each perforation, or zone of perforations, those of skill in the art have inserted production packers into the well annulus to isolate each perforation. Valves disposed on the production tubing control flow into the tubing from each perforated zone. One type of valve used in the industry for this function is the sliding sleeve valve. Typical sliding sleeve valves are disclosed in U.S. Pat. Nos. 4,560,005, 4,848,457, 5,211,241, 5,263,683, and 6,044,908, which are incorporated by reference herein in their entireties. In such a valve, a sleeve capable of longitudinal movement with respect to the production tube is located between a sleeve housing and the production tube. One or more ports extend radially through the sleeve, the housing, and the production tube. When the sleeve is in an open position, the ports of the sleeve, housing, and production tube are aligned such that fluid may flow through the ports and into the production tube. When the sleeve is in a closed position, the ports of the sleeve are not aligned with the ports on the housing or production tube, preventing fluid flow into the production tube. Although the sleeve can be moved longitudinally between the open and closed positions by several different means, it is common for such control to be hydraulic, essentially pushing the sleeve in a piston-like manner. (Valve control, however, can also be motor-driven or manually actuated).

It is important for production engineers to reliably know the position of a sliding sleeve valve, and particularly to know when the valve is fully opened or closed. Systems exist for continually determining the incremental position of the sleeve along its travel between fully open and full closed, such as are disclosed in the following references, which are incorporated herein by reference: U.S. Pat. No. 5,211,241; U.S. Pat. No. 5,263,683; U.S. patent application Ser. No. 10/339,263, filed Jan. 9, 2003; and U.S. patent application Ser. No. 10/373,146, entitled "Method and System for Determining and Controlling Position of a Valve," filed Feb. 24, 2003. However, while the ability to incrementally position valves in different hydrocarbon bearing zones allows for greater control of overall fluid production by permitting the creation of pressure drops across certain production zones, such level of control is not always necessary. For example, control of fluid ingress into the valve can be controlled more simply by a "duty cycling" approach, in which the valve is cycled between fully open and fully closed, as discussed in the above-incorporated patent applications. Moreover, such continual-monitoring, incremental position prior art approaches can be complex and expensive to implement.

Accordingly, what is desired is a system and method for reliability determining whether a sliding sleeve valve is fully opened or closed, i.e., a system and method for determining when the sliding sleeve has reached an end point in its position of travel.

SUMMARY OF THE INVENTION

Methods and systems for optical endpoint detection of a sliding sleeve valve are disclosed. The system comprises fiber optic cable based sensors (e.g., fiber Bragg gratings or fiber optic coils) positioned in a recess within the valve's housing and affixed proximate to the ends of the cavity in which the sleeve travels. When the sleeve reaches the ends of the cavity, it imparts a stress onto an area of the housing, which preferably constitutes a protrusion within the cavity, which in turn stresses the sensor and changes its reflection profile. This change in reflection profile indicates that the sleeve has traveled to an end point inside the valve, and accordingly that the valve is fully open or fully closed.

DESCRIPTION OF ILLUSTRATIVE EMBODIMENTS

Figure 1:
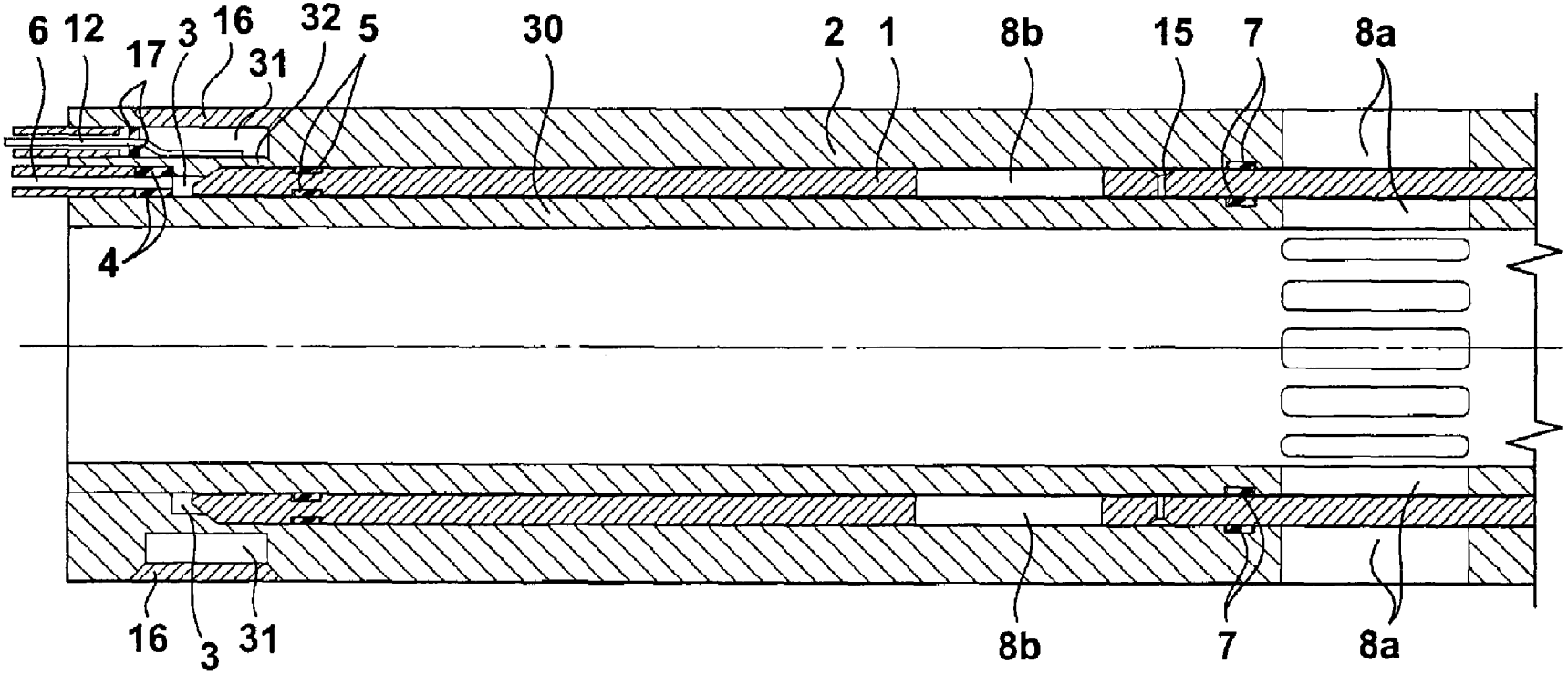
FIG. 1 is a cross-section of the disclosed optical end point detection system as used in conjunction with a sliding sleeve valve, which is illustrated in a closed position.

FIG. 1 discloses the basic structure of an exemplary sliding sleeve valve that benefits from the systems and methods disclosed herein for determining when the sleeve has reached an end point along its position of travel. The sliding sleeve 1 is positioned between a sleeve housing 2 and a production pipe 30. One skilled in the art will recognize that the housing 2 can be affixed to an otherwise standard section of production pipe 30, or may be integrally formed therewith as a single piece, i.e., as a special production tube section to be incorporated into the production string. Thus, as illustrated, the housing 2 and pipe 30 are integrated, but need not be so.

Within the housing 2 is a hydraulic cavity 3. The boundaries of the hydraulic cavity 3 are defined on one end by a sealable port 4, and on the other by one or more fluid-tight seal rings 5 (e.g. chevron seals) located on the sliding sleeve 1. Hydraulic fluid is forced into the hydraulic cavity 3 through a control line 6 that passes through the sealable port 4. Additional fluid tight seal rings 7 are located on the housing 2 to prevent hydrocarbons from entering the space between the sliding sleeve 1 and the housing 2. One skilled in the art will recognize that other non-hydraulic means of moving the sleeve within the housing 2 are known, such as by electrical means or by a wireline-deployable tool that physically latches onto and moves the sleeve.

Radial ports 8*a* are located in both the production tube 30 and the housing 2, and a radial port 8*b* is located in the sliding sleeve 1. The ports 8*a* and 8*b* can be brought into alignment, and the valve accordingly fully opened when the sleeve 1 is fully pushed to one side of the cavity 3 (i.e., to the right in FIG. 1; not shown) by the introduction of hydraulic fluid into the cavity. Similarly, the ports are not aligned when the sleeve is fully pushed to the other side of the cavity 3 (i.e., to the left in FIG. 1, as shown). A pressure relief aperture 15 in the sliding sleeve, such as that disclosed in U.S. Pat. No. 5,263,683, incorporated by reference herein, allows gradual pressure equalization during the movement of the sleeve 1 and thus prolongs the life of the fluid-tight seal rings 7.

Figure 2:
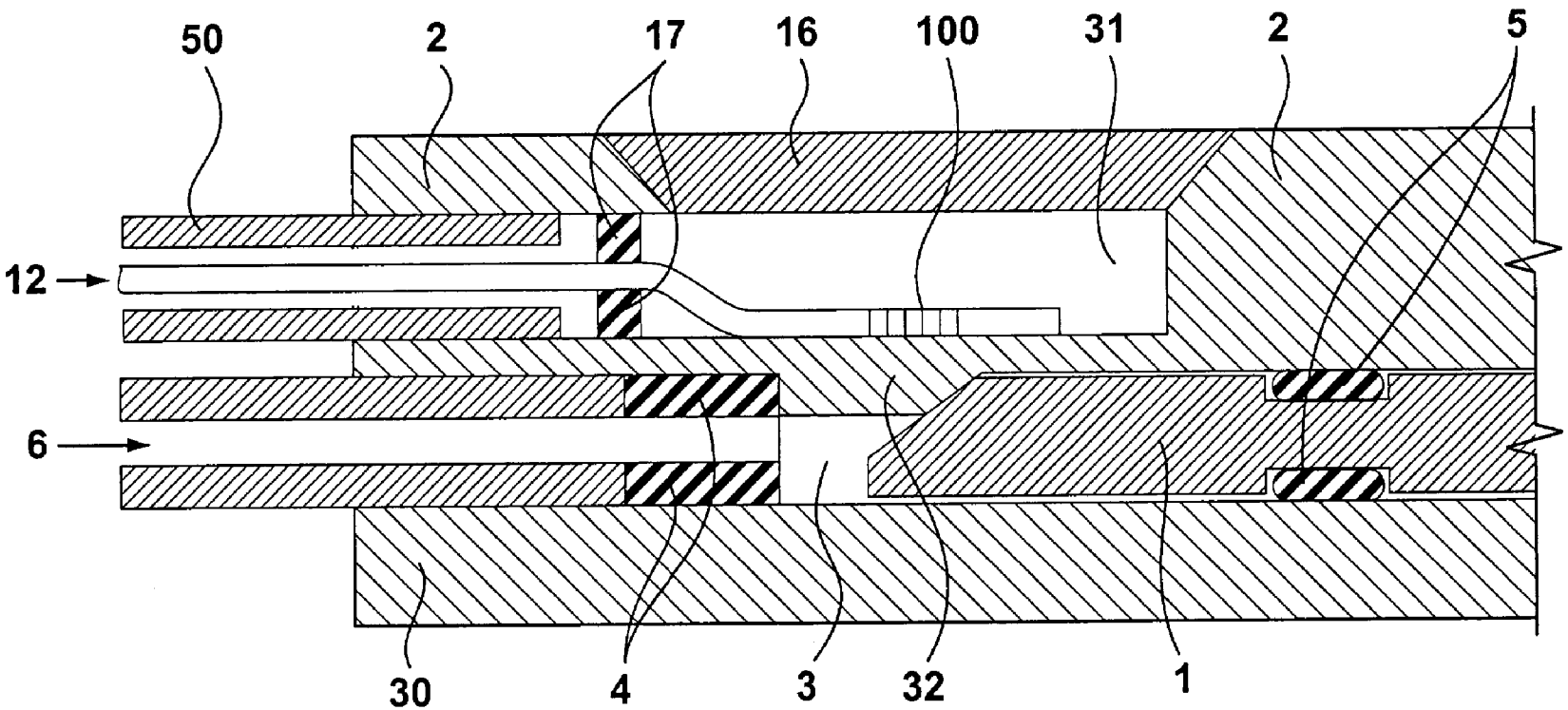
FIG. 2 is an enlarged cross-section of a portion of FIG. 1 showing the optical sensor (a fiber Bragg grating) and associated structures.

The disclosed embodiments for determining the position of the sleeve all preferably use fiber optic cable as the line of communication to the optical sensors that determine sleeve position. In this regard, a fiber optic cable 12 is introduced into a recess 31 in the housing 2 at feed-through assembly 17, as best shown in FIG. 2. Suitable high-pressure feedthrough assemblies are disclosed in U.S. patent application Ser. Nos. 09/628,114 and 09/628,264, which are incorporated by reference herein in their entireties. The fiber optic cable 12 preferably proceeds along the side of the production pipe between the surface instrumentation and the valve assembly, and may be protected within a metallic sleeve or sheath 50 and clamped or affixed to the production pipe as is well known. The sleeve 50 may contain other fiber optic cables which communicate with other fiber-optic based sensors deployed downhole, or may constitute a return path for the fiber optic based sensors disclosed herein. The surface instrumentation includes optical source/detection equipment, many of which are well known and useable with the various embodiments disclosed herein.

The recess 31 in the housing 2 is used to house the end point sensor as will be disclosed shortly. The recess 31 is mechanically and/or hermetically protected by cover 16, which can be bolted, welded, or affixed by any well-known means to the housing 2. The housing may be pressurized or evacuated, or filled with an inert or other gases, as is disclosed in U.S. Pat. No. 6,435,030, which is incorporated herein by reference in its entirety. Hermetically sealing the recess 31 helps to protect the sensors and keeps them from being unduly influenced by sources external to the housing 2.

FIG. 2 shows an exploded cross sectional view of the recess 31 used to house the various fiber optic based sensors disclosed herein, and shows a first embodiment of a position sensor for determining when the sliding sleeve 1 has reached an end point within the valve. In this first embodiment, the optical fiber 12 contains a fiber Bragg grating (FBG) 100 impressed within the core of the optical fiber. A FBG, as is known, is a periodic or a periodic variation in the effective refractive index of an optical waveguide, similar to that described in U.S. Pat. Nos. 4,725,110 and 4,807,950 entitled "Method For Impressing Gratings Within Fiber Optics," to Glenn et al. and U.S. Pat. No. 5,388,173, entitled "Method And Apparatus For Forming A periodic Gratings In Optical Fibers," to Glenn, which are incorporated by reference in their entireties. An FBG will reflect a narrow band of light, known as its Bragg reflection wavelength, $\lambda_B$, which will vary in accordance with the spacing, $\Lambda$, of the index of refraction variations formed in the waveguide. (More specifically, $\lambda_B \propto 2n_{eff}\Lambda$, where $n_{eff}$ is the index of refraction of the core of the cane waveguide or optical fiber). As this spacing is affected by physical or temperature-induced stresses, the Bragg wavelength will shift accordingly, which can be assessed to determine the magnitude of the presented pressure and/or temperature.

As shown in FIG. 2, a beveled edge of the sleeve 1 meets at it left-most point of travel within the cavity 3 a chamfered edge 32 of the housing 2. This contact creates a stress on the material of edge 32, which transfers to and slightly deforms the FBG 100. To properly detect this stress, the FBG 100 should be firmly affixed proximate to the edge 32, for example, by epoxy or another suitably solid adhesive. So configured, the FBG 100 may be periodically optically interrogated with broadband light to assess its Bragg reflection wavelength. If this reflection wavelength changes appreciably, it is then known that the sleeve 1 has reached its end point within the cavity, and that the valve is fully opened or closed. Modeling can be used to determine the amount of stress that the sleeve 1 will impart to edge 32, and by knowing the modulus of elasticity of the material of the housing 2 (of which edge 32 is a part), an assessment of the level of stress imparted to the FBG 100 can be estimated. Routine experimentation may be needed to determine the exact configuration, size, and thicknesses necessary to communicate sufficient stress from the edge 32 to the FBG 100, but the extreme sensitivity of FBGs to even the slightest mechanical stresses suggest that many configurations are possible.

In an alternative arrangement, the interrogating light may constitute narrow band light tuned to the Bragg reflection wavelength of the FBG 100 when it is not under stress. When stress due to end point contact is affected, the Bragg reflection wavelength of FBG 100 may be made to shift beyond the spectrum of that narrow band. Accordingly, no light would be reflected from the sensor, and this absence of light would be indicative of end point contact.

Although only one such sensor is shown, one skilled in the art will note that the recess 31 and cover 16 for the sensors preferably span the circumference of the cylindrical housing 2, such as is shown in FIG. 1. Accordingly, more than one sensor (i.e., FGB 100) can be arrayed around the recess 31 to provide multiple or redundant sensing of the contact between the sleeve 1 and the housing 2 (i.e. edge 32). If such an approach is used, the FBGs 100 can be multiplexed along a common fiber optic cable 12 within the recess, for example, by forming the cable 12 in a serpentine fashion within the recess. Preferably each FBG 100 would have a unique wavelength so that the FBGs can be wavelength division multiplexed, a well-known technique, although this is not strictly necessary.

Figure 3:
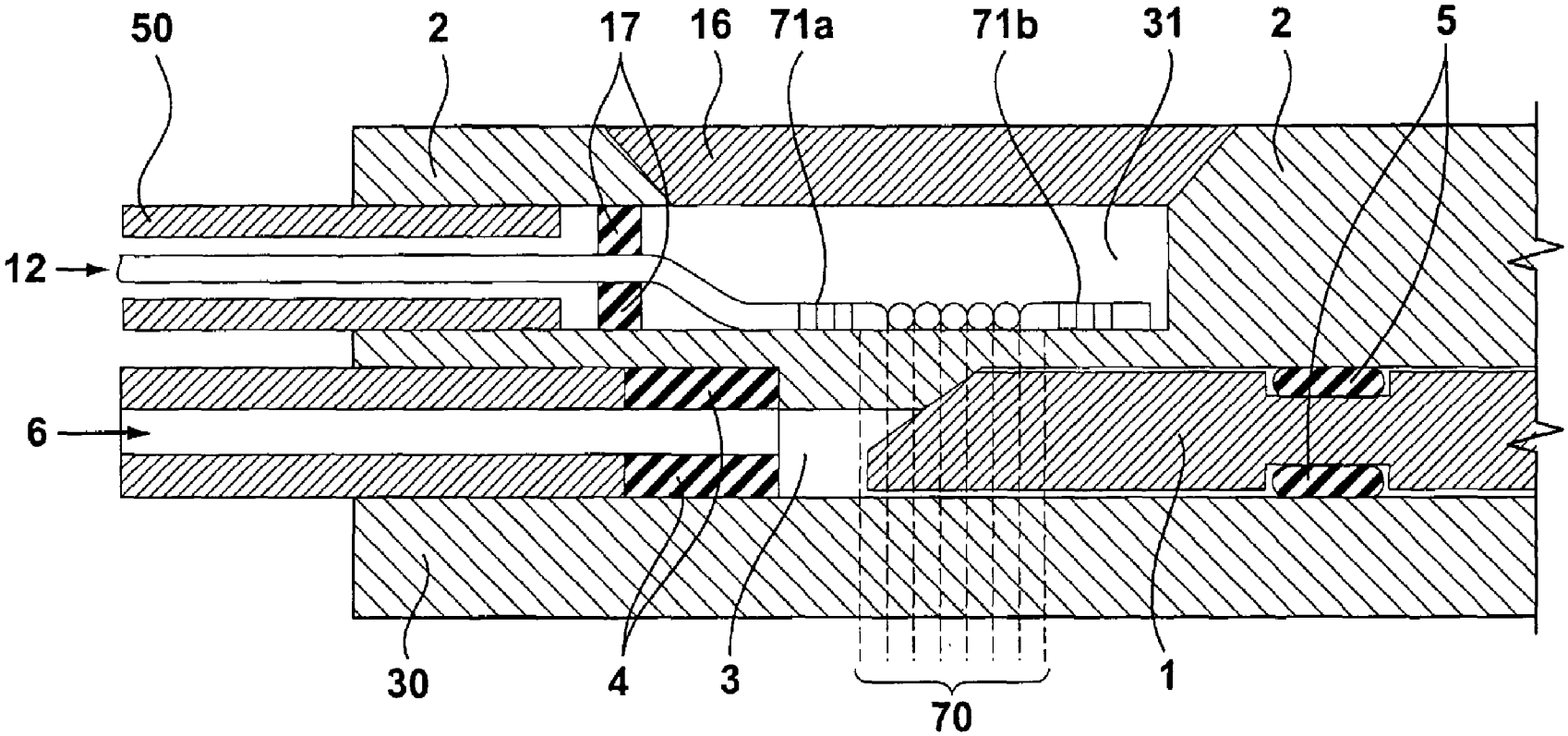
FIG. 3 is similar to FIG. 2, but discloses the use of a fiber optic coil as the sensor.

In another embodiment, shown in FIG. 3, a coil 70 is used as the end point sensor. In this embodiment, it is preferred that the recess 31, cover 16, and edge 32 span around the entirety of the circumference of the housing 2, such as in shown in FIG. 1. The coil 70 is wound around the portion of the edge 32 that is stressed by the contact between the sleeve 1 and the edge. The coil 70 is further bounded by two FBGs 71*a* and 71*b*. When contact occurs, the strain imparted to the edge 32 will cause the coil 70 to expand in length due to the slight change in circumference of the housing at this location. This change in length of the coil can is preferably interferometrically determined by assessing the interference pattern created by overlapping reflections from each of the FBGs, or determined by assessment of the delay in the time-of-flight between the FBGs 71*a*, 71*b*. Such optical detection schemes are disclosed in U.S. patent applicant Ser. No. 10/339,263, filed Jan. 9, 2003, which is incorporated by reference and hence not further discussed. As one skilled in the art will realize, particularly from a review of the references incorporated herein, the number of turns in coil 70 can be adjusted to increase or decrease the optical length of the coil, and hence increase or decrease its sensitivity.

As in the FBG-sensor embodiment of FIG. 2, is it preferred that the sensing coil 70 be firmly attached to the housing 2 to ensure good coupling of the end point strain from the edge 32 to the coil 70, with the use of epoxy being the preferred method. As the FBGs 71*a*, 71*b* are used merely to optically demarcate the coil 70, they need not be firmly attached to the housing 2. In fact, the FBGs may be placed on pads to isolate them from stress-induced wavelength shifts, such as are disclosed in U.S. Pat. No. 6,501,067, which is incorporated herein by reference in its entirety.

In either the FBG-sensor embodiment of FIG. 2 or the coil-sensor embodiment of FIG. 3, assessment of when the sleeve 1 has reached its end point and has made contact with edge 32 is accomplished by periodically optically interrogating that sensor at a suitable sampling rate and assessing its reflections accordingly. In this regard, the stress of contact between the edge 32 and the sleeve 1 will likely result initially in a significant impact stress, and thereafter impart a lower level of stress due to the static force of the sleeve against the edge as the sleeve is held in place. Both of these stress effects may be monitored by the disclosed sensing arrangement. If it is specifically desired to monitor initial impact stress at the end point (e.g., if significant static force between the sleeve 1 and the edge 32 is not present or is not maintained by the sleeve hydraulics), care should be taken that the sampling rate be suitably high when compared to the time constant of this impact stress.

It is preferred but not strictly necessary to use a chamfered edge 32 as the means for communicating the stress imparted from the end of the sleeve 1 through the housing 2 and ultimately to the optical sensor. One skilled in the art will recognize that given the extreme sensitivity of optical sensors to even the smallest changes in stress, many other arrangements are possible to allow the communication of this stress. In a general sense, any protrusion (such as edge 32) from the housing 2 into the hydraulic cavity 3, or other contact area between the sleeve 1 and the housing 2, could be sufficient to allow the transfer of stress to the optical sensors. U.S. patent application Ser. No. 10/373,146, WEAF145], entitled "Method and System for Determining and Controlling Position of a Valve," filed Feb. 24, 2003, incorporated herein by reference in its entirety, discloses other stress transfer techniques potentially useful in this regard.

Figure 4:
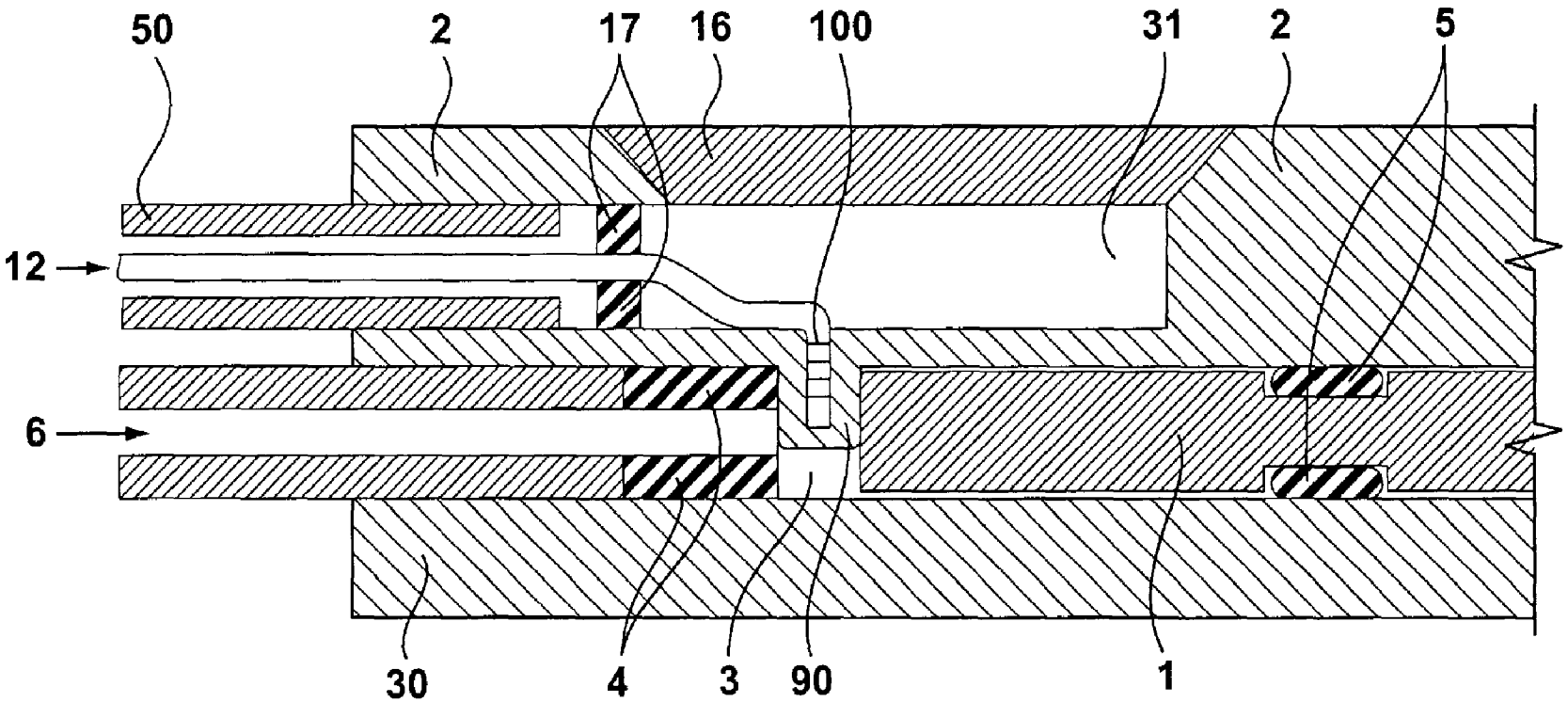
FIG. 4 is similar to FIG. 2, but discloses the orientation of the fiber Bragg grating at 90 degrees relative to the direction of the sliding sleeve.

In an alternative arrangement, shown in FIG. 4, a protrusion 90 extends from the housing 2 into the hydraulic cavity 3, and an FBG 100 is positioned therein. The FBG 100 is epoxied in place and is oriented at 90 degrees when compared to the FBG-sensor embodiment of FIG. 2. However, end point detection works on the same principle: when the sleeve 1 contacts the protrusion 90, the protrusion stresses slightly, which is detected as a shift in the Bragg reflection wavelength. Thus, end point detection is achievable whether the FBG is oriented parallel to the movement of the sleeve (FIG. 2) or perpendicular to the movement of the sleeve 1 (FIG. 4), or is oriented at other angles. Moreover, instead of being formed in a protrusion 90, the FBG can simply be epoxied or otherwise affixed in a flat end wall of the cavity, which is essentially what FIG. 4 shows.

In yet a further modification, the optical sensor (e.g., FBG) could be ported directly in the hydraulic cavity 3 from the recess 31 such that it can be directly contacted by the sleeve at its end point (not shown). However, exposure of the optical sensor to hydraulic fluids present in the cavity 3 may negatively affect its performance, but this can be mitigated by appropriately coating the sensor. Additionally, care should be taken to prevent the optical sensor from becoming crushed between the sleeve 1 and the housing 2, for example, by affixing the optical fiber in a groove at the point of contact between the sleeve 1 and the housing 2. Affixing the FBG in a groove would allow a sufficient amount of stress from the sleeve 1 to touch and deform the sensor, but would limit the amount of stress that could be directly imparted to the FBG, thus protecting it from damage. For example, the groove could be cut so that only a small portion of the FBG protrudes over the surface that the sleeve contacts when the FBG lays in the groove, thus allowing only slight deformation that would not permanently damage the FBG. Or, the FBG could be of a diameter smaller than the groove such that it would not protrude, but such that the strain on the surrounding metal would affect the FBG and indicate contact.

Although the area of the housing (e.g., edge 32, or protrusion 90) which receives the stress from the sleeve 1 is preferably formed integral with and of the same material as the housing 2, this is not strictly necessary. In this regard, even if the area of the housing which receives and transmits the stress to the sensors constitute a separate piece from the bulk material of the housing, such a piece should still be considered as part of the housing.

Figure 5:
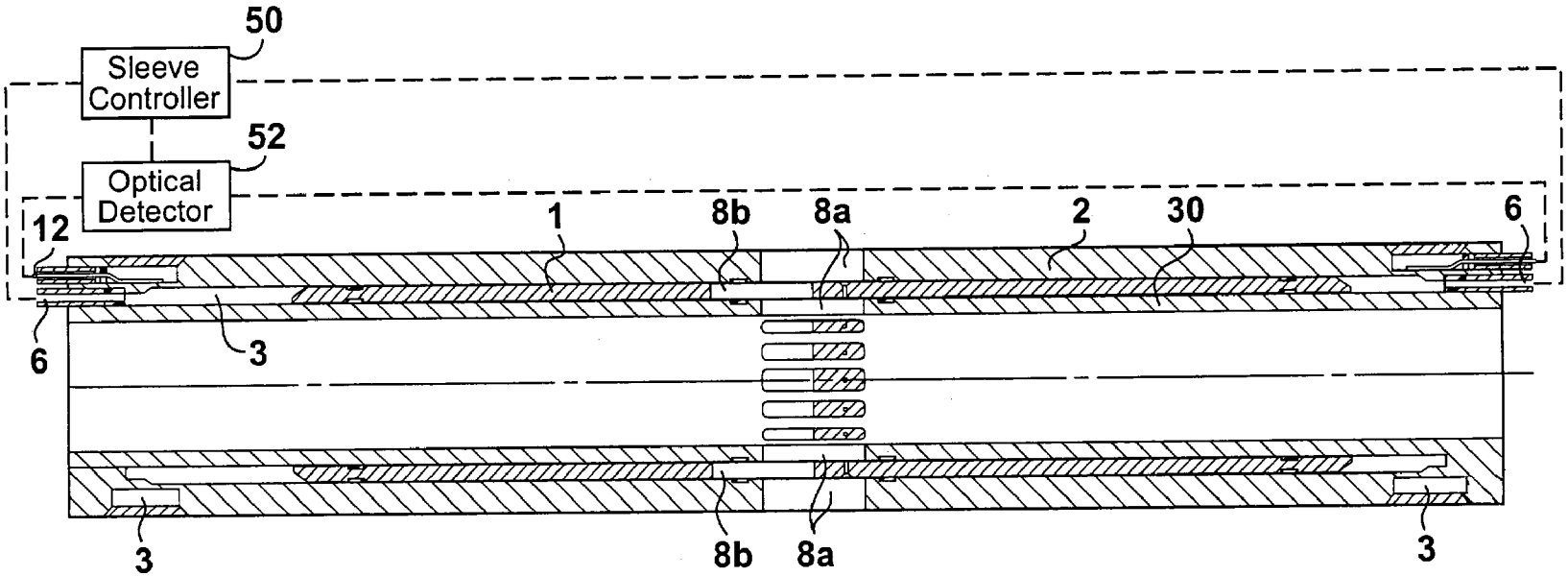
FIG. 5 is a cross-section of the disclosed optical end point detection system as used in a dual-ended configuration, and in which the sliding sleeve is illustrated in a half-opened position.

The disclosed end point detection schemes and optical sensor arrangements for the sliding sleeve valve preferably appear at both ends of the sleeve 1 as shown in FIG. 5, thus allowing for the detection of the sleeve at both ends, and consequently whether the sleeve is fully opened or fully closed. In such a dual-ended approach, the sensors on each end can be multiplexed along a single optical fiber 12. If multiplexed, a sealable channel (not shown) could be formed in the housing 2 to route the cable 12 through the middle of the housing 2 between the two recesses 31, in which case, the channel is preferably made to run in areas where the radial ports 8*a* are not present. Alternatively, the recesses 31 could be optically coupled by passing the cable through additional feedthroughs 17 (not shown). However, if desired, end point detection of only one end of the sleeve 1 may be performed.

End point detection may also be used to control the hydraulics (or electronics) that move the sleeve. For example, and as shown in FIG. 5, cable 12 can be coupled to an optical source/detector 50. End point detection information as determined by source/detector 50 can be passed to or incorporated with hydraulic (or electronic) sleeve controller 52 in a feedback loop. If end point contact is not detected, the sleeve controller 52 can be prompted by the detector 50 to keep pushing the sleeve 1. When end point contact is detected, the sleeve controller 52 can be prompted by the detector to cease pushing the sleeve.

While of particular utility to sliding sleeves usable in oil/gas wells, it should be recognized that the concepts disclosed herein have applicability to determining the position of other actuatable structures, such as pistons, cam shafts, etc., including structures that are hydraulically activated using gases or liquids.

"Sensor" should be understood as referring to that portion of the fiber 12 which acts as the sensor, whether this be a bare portion of the fiber, a FBG, a coil, or other cable structures acting as the position sensors according to the techniques disclosed herein, and whether or not expressly disclosed herein.

Although the invention has been described and illustrated with respect to exemplary embodiments thereof, the foregoing and various other additions and omissions may be made therein and thereto without departing from the spirit and scope of the present invention as defined in the attached claims.

What is claimed is:

1. An apparatus for end point detection for a sliding sleeve valve, comprising:

a housing coupleable to a conduit;

a sliding sleeve, wherein the sleeve can slide to contact at least a first area of the housing to impart a stress to the first area when the sleeve is at the end point; and at least one optical sensor for detecting the stress imparted to the first area by sensing the stress imparted to a location on an outside of the housing, the at least one optical sensor disposed proximate the first area of the housing and on an opposite side of the housing from the sleeve.

2. The apparatus of claim 1, wherein the sensor comprises optical fiber.

3. The apparatus of claim 2, wherein the sensor further comprises a coil of optical fiber wrapped circumferentially around the housing.

4. The apparatus of claim 3, wherein the coil is bounded by a pair of fiber Bragg gratings.

5. The apparatus of claim 2, wherein the sensor comprises a fiber Bragg grating.

6. The apparatus of claim 5, wherein the grating is oriented parallel to an axis along which the sleeve slides.

7. The apparatus of claim 5, wherein the grating is oriented perpendicular to an axis along which the sleeve slides.

8. The apparatus of claim 1, wherein the housing and sleeve are cylindrical and concentric around the conduit.

9. The apparatus of claim 1, wherein the area comprises a chamfered edge of the housing.

10. The apparatus of claim 1, wherein the area comprises a protrusion.

11. The apparatus of claim 1, wherein the sleeve can slide to contact the first and a second area of the housing respectively to impart a stress to the first and second area, and further comprising at least one optical sensor for detecting the stress imparted to the second area.

12. The apparatus of claim 1, wherein the at least one optical sensor comprises a plurality of sensors.

13. The apparatus of claim 1, wherein the sliding sleeve is contained in a cavity formed in the housing.

14. The apparatus of claim 1, wherein the at least one optical sensor is contained within a first recess.

15. The apparatus of claim 14, wherein the first recess is formed in the housing proximate to the first area of the housing.

16. A method for detecting the end point of a sleeve in a sliding sleeve valve having a housing, comprising:

actuating the sleeve to bring the sleeve into contact with an inside of the housing to impart a stress to a first area of the housing when the sleeve is at the end point; and optically detecting the stress at the first area to determine that the sleeve has reached a first end point by sensing the stress imparted to a location on an outside of the housing.

17. The method of claim 16, wherein optically detecting the stress comprises assessing a reflection profile of an optical sensor.

18. The method of claim 17, wherein the reflection profile comprises a Bragg reflection wavelength.

19. The method of claim 17, wherein the reflection profile comprises interfering reflection from sensors binding a length of optical fiber.

20. The method of claim 17, wherein the sensor further comprises a coil of optical fiber wrapped circumferentially around the housing.

21. The method of claim 20, wherein the coil is bounded by a pair of fiber Bragg gratings.

22. The method of claim 17, wherein the sensor comprises a fiber Bragg grating.

23. The method of claim 22, wherein the grating is oriented parallel to an axis along which the sleeve slides.

24. The method of claim 22, wherein the grating is oriented perpendicular to an axis along which the sleeve slides.

25. The method of claim 16, wherein the sensor comprises optical fiber.

26. The method of claim 16, wherein the housing and sleeve are cylindrical and concentric around a conduit.

27. The method of claim 16, wherein the area comprises a chamfered edge of the housing.

28. The method of claim 16, wherein the area comprises a protrusion.

29. The method of claim 16, further comprising:

actuating the sleeve within a cavity within the housing to bring the sleeve into contact with the first and a second areas of the housing respectively proximate to first and second ends of the cavity to respectively impart stresses to the first and second areas;

optically detecting the stresses at the first and second areas to respectively determine that the sleeve has reached first and second end points in the cavity.

30. The method of claim 16, wherein the sliding sleeve is contained in a cavity formed in the housing.

31. An apparatus for end point detection for a sliding sleeve valve, comprising:

a housing coupleable to a conduit;

a cavity formed in the housing containing a sliding sleeve, wherein the sleeve can slide to contact at least a first area of the housing proximate to a first end of the cavity to impart a stress to the first area when the sleeve is at the end point; and a first recess formed in the housing proximate to the first area of the housing, wherein the first recess contains at least one optical sensor for detecting the stress imparted to the first area by sensing the stress imparted to a location on an outside of the housing, wherein the at least one optical sensor comprises a coil of optical fiber wrapped circumferentially around the recess.

32. The apparatus of claim 31, wherein the coil is bounded by a pair of fiber Bragg gratings.

33. An apparatus for end point detection for a sliding sleeve valve, comprising:

a housing coupleable to a conduit;

a cavity formed in the housing containing a sliding sleeve, wherein the sleeve can slide to contact at least a first area of the housing proximate to a first end of the cavity to impart a stress to the first area when the sleeve is at the end point; and a first recess formed in the housing proximate to the first area of the housing, wherein the first recess contains at least one optical sensor for detecting the stress imparted to the first area, wherein the at least one sensor is a fiber Bragg grating oriented perpendicular to an axis along which the sleeve slides in the cavity.

* * * * *